US006112567A

United States Patent [19]

Birkert

[11] Patent Number: 6,112,567

[45] Date of Patent: Sep. 5, 2000

[54] METHOD AND APPARATUS FOR MANUFACTURING A HOLLOW BODY FROM A TUBULAR BLANK BY INTERNAL HIGH-PRESSURE SHAPING

[75] Inventor: Arndt Birkert, Bretzfeld-Unterheimbach, Germany

[73] Assignee: DaimlerChrysler AG, Stuttgart, Germany

[21] Appl. No.: 09/275,778

[22] Filed: Mar. 25, 1999

[30] Foreign Application Priority Data

Mar. 25, 1998 [DE] Germany ..... 198 13 012

[51] Int. Cl.[7] ..... B21D 26/02

[52] U.S. Cl. ..... 72/58; 72/61; 72/370.22

[58] Field of Search ..... 72/58, 61, 62, 72/370.6, 370.22, 367.1

[56] References Cited

U.S. PATENT DOCUMENTS

| | | | |
|---|---|---|---|
| 3,147,545 | 9/1964 | Valyi | 72/58 |
| 4,567,743 | 2/1986 | Cudini . | |
| 4,928,509 | 5/1990 | Nakamura | 72/61 |
| 5,070,717 | 12/1991 | Boyd et al. | 72/57 |
| 5,333,775 | 8/1994 | Bruggemann et al. | 72/61 |
| 5,339,667 | 8/1994 | Shah et al. | 72/58 |
| 5,557,961 | 9/1996 | Ni et al. | 72/61 |
| 5,813,266 | 9/1998 | Ash | 72/57 |
| 5,987,950 | 11/1999 | Horton | 72/58 |
| 6,016,603 | 1/2000 | Marando et al. | 72/61 |

FOREIGN PATENT DOCUMENTS

| | | |
|---|---|---|
| 0294034A | 12/1988 | European Pat. Off. . |
| 19518252A | 11/1996 | Germany . |
| 19633760A | 3/1998 | Germany . |

*Primary Examiner*—David Jones
*Attorney, Agent, or Firm*—Evenson, McKeown, Edwards & Lenahan, P.L.L.C.

[57] ABSTRACT

The invention relates to a method for shaping a hollow body from a tubular blank inserted into a shaping tool that can be opened and closed, by internal high pressure introduced into the interior of the blank. The cross section of the blank, prior to the internal high-pressure shaping, can be changed and pre-shaped from a round or rectangular shape, depending on the workpiece. In order to be able to produce workpieces with a circumference that varies considerably over the length without overstretching the material, according to the invention, for pre-shaping the blank, a dent that differs in depth over its length is formed in the blank. During the internal high-pressure shaping of the pre-shaped blank to form a hollow body, a U-shaped fold is formed from the dent that projects into the interior of the hollow body, with the walls of the fold abutting one another directly and merging at the periphery with the circumferential wall of the hollow body. The two walls of the fold are permanently connected to one another and the two walls of the fold are preferably permanently welded together in the vicinity of the circumference of the hollow body.

13 Claims, 2 Drawing Sheets

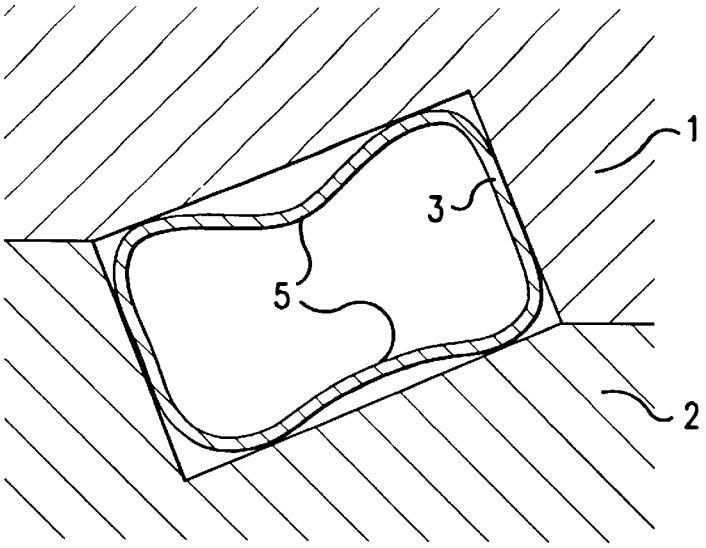
FIG.3
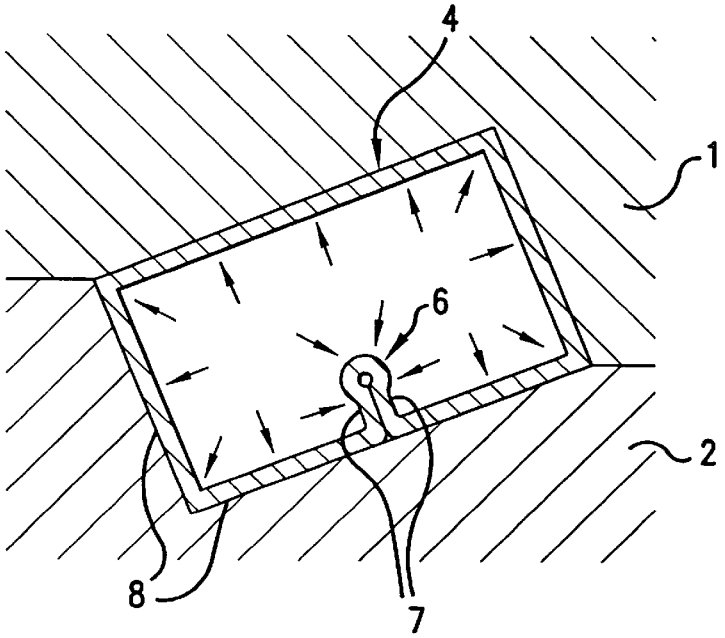
FIG.4
FIG.5a
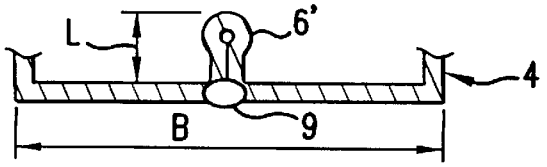
FIG.5b
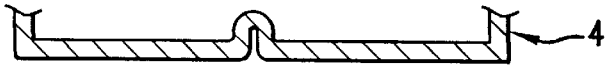
FIG.5c
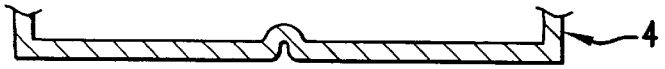

METHOD AND APPARATUS FOR MANUFACTURING A HOLLOW BODY FROM A TUBULAR BLANK BY INTERNAL HIGH-PRESSURE SHAPING

BACKGROUND AND SUMMARY OF THE INVENTION

This application claims the priority of German application 198 13 012.0, filed Mar. 25, 1998, the disclosure of which is expressly incorporated by reference herein.

The invention takes its departure from a method for manufacturing a hollow body from a tubular blank by internal high-pressure shaping.

Previously, round or rectangular tubular sections had to be pre-shaped as blanks for the internal high-pressure shaping process as a function of the workpiece, with pre-shaping taking place in a separate pre-shaping tool or in the internal high-pressure shaping tool. However, the only solutions known in this connection are those in which the smallest circumference of the finished part corresponds to the circumference of the blank to be inserted, in other words the blank is dimensioned according to the smallest circumference of the finished part.

An exception is the pinching off of areas of the tube when the internal high-pressure shaping tool is closed. A kink with twice the wall thickness of the raw material then forms on the exterior of the tube. The space requirement for the kink has proven to be problematic. Separation of the kink would entail an additional workstep; in addition, the torsional rigidity of the finished part would be adversely affected.

Since the circumference of the tube to be inserted as a rule corresponds to the minimum circumference of the finished part, the possible part cross sections can be varied only within narrow limits. For example, if the part to be made has a circumference at the smallest point of 100 mm and 150 mm at the largest point in the finished state, a blank with a circumference of 100 mm is usually used. This means however that areas with a large circumference in the circumferential direction must be expanded by approximately 50% for example. This is not possible with ordinary metal materials. In the past, when it was necessary to produce internal high-pressure shaped parts with greater differences in diameter, the only option was to perform the shaping in several shaping steps and to regenerate the shapability of the material by intermediate annealing, which is very costly in terms of investment outlay, space requirements, and operating costs. An alternative is to use blanks that have been assembled from a number of parts (so-called tailored tubes) which are welded together from tubular sections with transition cones of different sizes. This involves expensive and time-consuming manufacture of blanks.

A goal of the invention is to improve the basic method of the above described type in such fashion that finished parts can be produced with larger differences in diameter or circumference (more than 15% for example) between the largest and smallest diameters using metal materials in conventional use today simply by internal high-pressure shaping.

This goal, on the basis of the basic method is achieved according to the invention by a method of the above noted type, wherein, for pre-shaping of the blank, a dent whose depth varies over its length is formed in the blank, said dent being configured so that a U-shaped fold that projects into the interior of the hollow body is formed with the walls of said fold abutting one another directly and merging at the periphery with a circumferential wall of hollow body to thereby facilitate the internal high-pressure shaping of the pre-shaped blank to form a hollow body with a circumference that varies sharply over its length.

During the pre-shaping of the blank, a dent is formed whose depth varies over its length, from which a U-shaped fold is formed during the actual internal high-pressure shaping process that projects into the interior of the hollow body and whose walls abut one another directly and blend at the periphery with the circumferential wall of the hollow body. Thus, a blank can be produced that is larger in circumference than the smallest circumference or smallest diameter of the finished part. On the basis of the fold, which is directed inward and hence does not pose any difficulties, circumferential material can be "used up" and thus the diameter or circumference of the blank can intentionally be reduced locally. As a result, larger blanks can be used whose circumferential length or diameter is between the maximum and minimum diameters of the finished part. As a result, the circumferential expansion of the workpiece in areas with a large finished-part circumference can be kept within tolerable limits. The range of parts that can be manufactured with conventional simple blanks is considerably expanded, thanks to the invention.

Other objects, advantages and novel features of the present invention will become apparent from the following detailed description of the invention when considered in conjunction with the accompanying drawings.

BRIEF DESCRIPTION OF THE DRAWINGS

FIG. 3 shows the tool according to FIG. 1 in a completely closed state, with the blank being intentionally provided with lengthwise dents;

FIG. 4 shows the tool according to FIG. 3 in the state in which it is subjected to high pressure, with the blank being accurately shaped in the die of the shaping tool and a U-shaped fold being formed inside the workpiece; and FIGS. 5*a*, 5*b*, 5*c* show a series of cross sections through the wall of the finished internal high-pressure shaped part with the fold at different lengthwise positions.

DETAILED DESCRIPTION OF THE INVENTION

Figure 1:
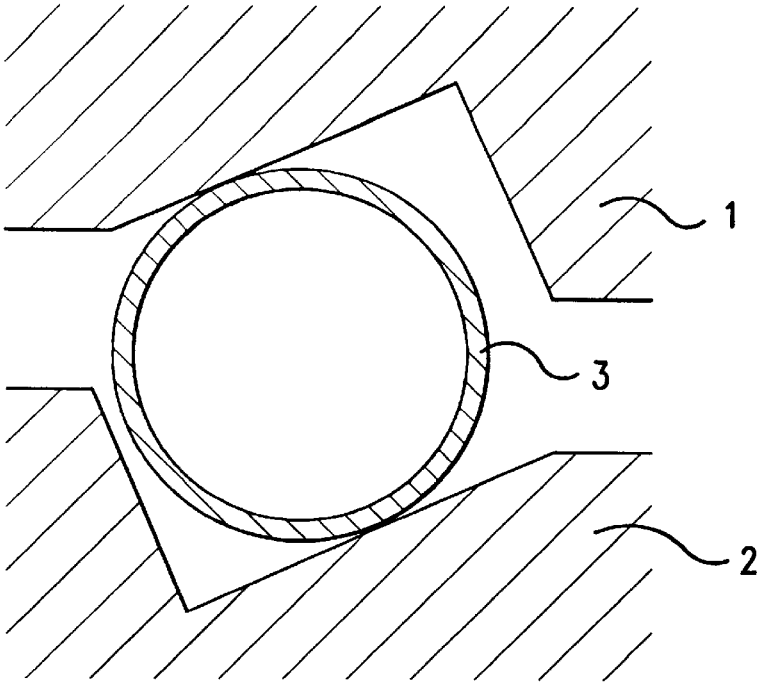
FIG. 1 shows a cross section through an open internal high-pressure shaping tool with a blank made of a round tube placed inside, in accordance with a preferred embodiment of the invention.

By using the closable internal high-pressure shaping tool shown in the figures and divided into an upper and a lower tool 1 and 2, a round blank 3 is to be shaped to form a box-shaped finished part 4, whose cross section in the finished state has different circumferential lengths at different lengthwise positions.

For this purpose, according to the invention, a dent 5 is formed in the cross section of the blank, said dent being of different depths over its length. During the internal high-pressure shaping of the pre-shaped blank to form a hollow body 4, a U-shaped fold 5 is formed from the dent, said fold projecting into the interior of the hollow body, with the walls 7 of said fold abutting one another directly and blending at the periphery into the circumferential wall 8 of the hollow body.

Figure 2:
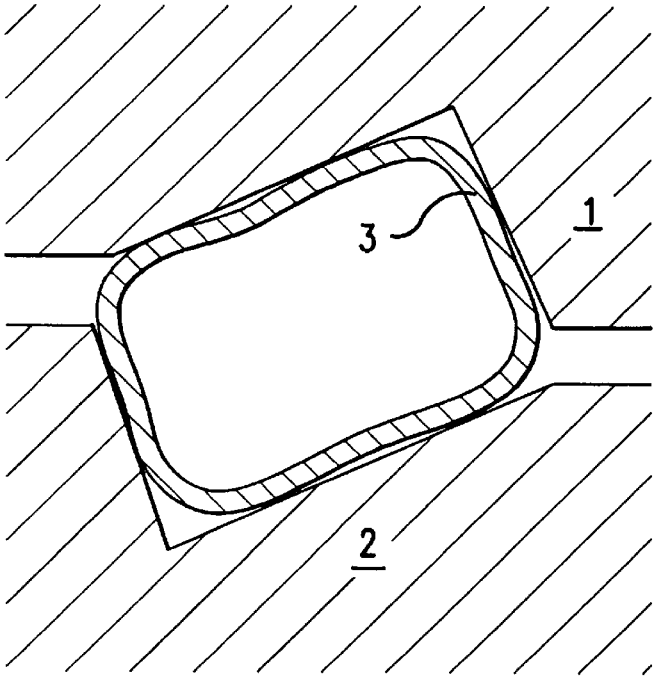
FIG. 2 shows the tool according to FIG. 1 in a partially-closed state with the blank being intentionally partially shaped.

In the embodiment shown, the pre-shaping of the blank by denting or kinking the wall of the blank is performed automatically by the internal high-pressure shaping tool in the course of its closing motion, as indicated by the sequence of FIGS. 1 to 3. If necessary, the blank can be pre-shaped by denting or kinking the wall of the blank at several circumferential points on the blank.

In many applications, the simple adjoining of the fold walls 7 can be sufficient as far as the stability of the part is concerned, especially if they are not spread when the part is stressed or do not move apart. However, if this is a case with certain stress on the part, the two walls 7 of the fold can be connected permanently to one another, for example they can be glued to one another over their entire surfaces. The adhesive could be added even as early as the blank state. One advantageous method of stabilizing the fold on the outside consists in permanently welding the two walls of the fold to one another in the vicinity of the circumference of the hollow body (weld 9 in FIG. 5*a*).

The sequence of FIGS. 5*a*, 5*b*, 5*c* is intended, together with the finished part located in FIG. 4 inside the internal high-pressure shaping tool, to show how fold 6 becomes shorter relative to its length L that projects into the interior of the part as the width b of finished part 4 increases.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for shaping a hollow body from a tubular blank placed in a shaping tool that can be opened and closed, by internal high pressure introduced into the interior of the blank, with the blank, prior to internal high-pressure shaping, being modified in the shape of a cross section in accordance with the workpiece from a standardized delivered cross-sectional shape, wherein, for pre-shaping of the blank, a dent whose depth varies over its length is formed in the blank, said dent being configured so that a U-shaped fold that projects into the interior of the hollow body is formed with the walls of said fold abutting one another directly and merging at the periphery with a circumferential wall of the hollow body to thereby facilitate the internal high-pressure shaping of the pre-shaped blank to form a hollow body with a circumference that varies sharply over its length.

2. Method according to claim 1, wherein two walls of the fold are permanently connected to one another.

3. Method according to claim 2, wherein two walls of the fold are permanently welded together in the vicinity of the circumference of the hollow body.

4. Method according to claim 1, wherein the pre-shaping of the blank by denting or kinking the wall of the blank is performed automatically by an internal high-pressure shaping tool during its closing movement.

5. Method according to claim 1, wherein the pre-shaping of the blank is performed by denting or kinking the wall of the blank at several circumferential points on the blank.

6. Method of making a hollow body comprising:

placing a tubular blank in a shaping tool that can be opened and closed, said tubular blank being modified in shape from a standardized constant cross-sectional shape by inclusion of a dent which varies in size over the length of the blank, and application of internal high pressure into the tubular blank and closing the shaping tool to thereby form a U-shaped fold projecting into the tubular blank along the dent with walls of said U-shaped fold abutting one another and merging at a periphery of a circumferential wall of the hollow body formed from the tubular blank.

7. Method according to claim 6, wherein two walls of the fold are permanently connected to one another.

8. Method according to claim 7, wherein two walls of the fold are permanently welded together in the vicinity of the circumference of the hollow body.

9. Method according to claim 6, wherein the pre-shaping of the blank is performed with denting of the wall of the blank to form a changing fold size along the length of the blank.

10. Method according to claim 6, wherein the pre-shaping of the blank is performed by denting or kinking the wall of the blank at several circumferential points on the blank.

11. Apparatus for making a hollow body, comprising:

a shaping tool that can be opened and closed, a tubular blank, placeable in the shaping tool, said tubular blank being modified in shape from a standardized constant cross-sectional shape by inclusion of a dent which varies in size over the length of the dent formed in the blank, and means for application of internal high pressure into the tubular blank and closing the shaping tool to thereby form a U-shaped fold projecting into the tubular blank along the dent with walls of said U-shaped fold abutting one another and merging at a periphery of a circumferential wall of the hollow body formed from the tubular blank.

12. Apparatus according to claim 11, comprising means for permanently connecting two walls of the fold permanently together.

13. Apparatus according to claim 11, comprising welding means for permanently connecting two walls of the fold permanently together.

* * * * *